US007784469B2

(12) United States Patent
De Pietra et al.

(10) Patent No.: US 7,784,469 B2
(45) Date of Patent: Aug. 31, 2010

(54) AUTOMATIC MACHINE FOR PROCESSING ARTICLES IN THE TOBACCO INDUSTRY, AND RELATIVE CONTROL METHOD

(75) Inventors: Gaetano De Pietra, Casalecchio di Reno (IT); Verter Cesari, Granarolo Dell'Emilia (IT)

(73) Assignee: G.D Societa per Azioni (IT)

( * ) Notice: Subject to any disclaimer, the term of this patent is extended or adjusted under 35 U.S.C. 154(b) by 879 days.

(21) Appl. No.: 11/533,525

(22) Filed: Sep. 20, 2006

(65) Prior Publication Data

US 2007/0068541 A1 Mar. 29, 2007

(30) Foreign Application Priority Data

Sep. 28, 2005 (IT) ..... BO05A0585

(51) Int. Cl.
*A24C 5/32* (2006.01)
*A24C 5/34* (2006.01)

(52) U.S. Cl. ..... 131/280; 131/910; 700/117; 700/83; 700/95; 700/180; 700/275

(58) Field of Classification Search ..... None
See application file for complete search history.

(56) References Cited

U.S. PATENT DOCUMENTS 6,718,222 B2 * 4/2004 Bergo et al. ..... 700/117
2003/0178037 A1 * 9/2003 Draghetti et al. ..... 131/280

FOREIGN PATENT DOCUMENTS

DE 197 53 704 6/1999
WO WO 99/17923 4/1999

OTHER PUBLICATIONS

Search Report issued by European Patent Office on Jan. 29, 2007 in connection with corresponding European patent application No. EP 06 12 1360.

* cited by examiner

*Primary Examiner*—Philip C Tucker
*Assistant Examiner*—Phu H Nguyen
(74) *Attorney, Agent, or Firm*—Ostrolenk Faber LLP

(57) ABSTRACT

An automatic machine for processing articles in the tobacco industry, and relative control method; the automatic machine has a production line along which a number of materials are processed to produce the articles; a number of operating members located along the production line; a control unit for controlling data relating to operation of the automatic machine; and a user interface device connected to the control unit and having a memory device which stores data belonging to the following classes: error messages resulting in automatic stoppage of the automatic machine; report messages; operator-intervention-request messages; production counters; values of analog and digital internal control variables; position/speed signals; format-change requests; end-of-shift requests; and operating parameters of the automatic machine.

12 Claims, 4 Drawing Sheets

AUTOMATIC MACHINE FOR PROCESSING ARTICLES IN THE TOBACCO INDUSTRY, AND RELATIVE CONTROL METHOD

The present invention relates to an automatic machine for processing articles in the tobacco industry, and to a relative control method.

The present invention may be applied to advantage in an automatic cigarette packing machine, to which the following description refers purely by way of example.

BACKGROUND OF THE INVENTION

A currently marketed automatic cigarette packing machine comprises a user interface device, which communicates on one side with a control unit of the packing machine and, on the other, with an operator. Communication with the operator may be either local, i.e. the operator is physically close to the machine, or remote (over a local TCP/IP protocol network and/or Internet network). Currently marketed user interface devices employ an SQL database comprising a history data table, in which the values assumed by various control variables during particular events are memorized. More specifically, the history data table memorizes all the machine stop messages, i.e. relating to events resulting in stoppage of the machine, and, for each machine stop message, normally memorizes the type of event the message refers to, any parameters connected with the event, machine stoppage start date and time, machine stoppage end date and time, a shift identification code, and a machine identification code. The history data table is queue-managed, in the sense that a new event, as opposed to being written over an existing event in the table, is added "to the end of the queue"; and, to maintain a reasonable size of the history data table, events stored over and above a given threshold period (e.g. 1 month) are periodically deleted.

The information stored in the history data table is not always sufficient to determine what has actually caused stoppage of the packing machine. That is, even in the event of actual problems on the packing machine, the machine is frequently stopped by the operator, for control, adjustment, and maintenance purposes, prior to automatic stoppage by the control unit. As a result, most of the machine stoppages in the history data table are recorded as operator-induced, with no way of determining what has induced the operator to stop the machine.

Moreover, even when the machine is stopped by the control unit on the basis of a malfunction signal, only the cause of the stoppage is known, with no information as to what lies beneath the cause.

SUMMARY OF THE INVENTION

It is an object of the present invention to provide an automatic machine for processing articles in the tobacco industry, and a relative control method, both designed to eliminate the aforementioned drawbacks, and which, in particular, are cheap and easy to implement.

According to the present invention, there are provided an automatic machine for processing articles in the tobacco industry, and a relative control method, as claimed in the attached Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
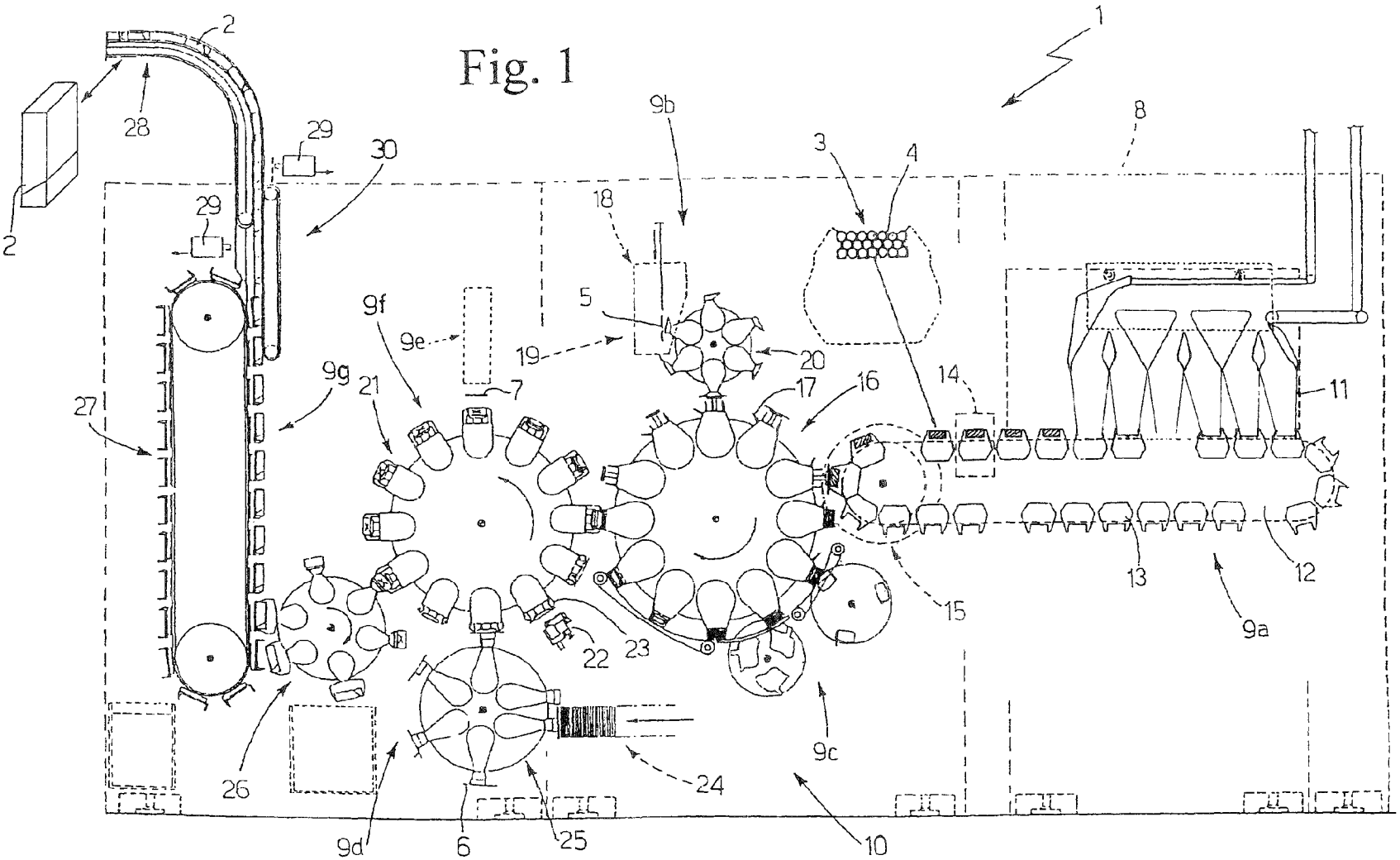
FIG. 1 shows a schematic front view of an automatic cigarette packing machine in accordance with the present invention.

Number 1 in FIG. 1 indicates as a whole an automatic machine for producing rigid packets 2 of cigarettes, each of which comprises an orderly group 3 of cigarettes 4 wrapped in a sheet 5 of foil; and a blank 6, which is folded about group 3 of cigarettes 4 wrapped in sheet 5 of foil, to define a hinged-lid container. A U-folded collar 7 is inserted inside the container, at an open top end of the container, to engage an inner surface of the lid when the lid is in a closed position.

Machine 1 comprises a frame 8 shown by a dash line in FIG. 1 and supporting a number of work stations 9 arranged along a production line 10, and each of which comprises a respective number of operating devices. More specifically, machine 1 comprises seven work stations 9: a station 9*a* for forming groups 3 of cigarettes 4; a station 9*b* for supplying sheets 5 of foil; a station 9*c* for folding sheets 5 of foil about groups 3 of cigarettes 4; a station 9*d* for supplying blanks 6; a station 9*e* for supplying collars 7; a station 9*f* for folding blanks 6 and collars 7 about groups 3 of cigarettes 4 and on top of the previously folded sheets 5 of foil; and a station 9*g* for completing and drying packets 2.

The following is a description of the main operating devices of each work station 9 as shown in FIG. 1. In actual fact, each work station 9 obviously comprises additional operating devices that cannot be detailed in FIG. 1.

Station 9*a* for forming groups 3 of cigarettes 4 comprises a hopper 11 having a number of outlets for groups 3 of cigarettes 4; a forming conveyor 12 having trains of pockets 13, each for receiving a group 3 of cigarettes 4 from hopper 11; optical control devices 14; and a transfer wheel 15.

Station 9*c* for folding sheets 5 of foil about groups 3 of cigarettes comprises a packing wheel 16 having a number of folding heads 17, each of which receives a group 3 of cigarettes 4 from transfer wheel 15, receives a sheet 5 of foil from supply station 9*b*, and folds sheet 5 of foil about group 3 of cigarettes 4 with the aid of external folding members.

Station 9*b* for supplying sheets 5 of foil comprises a feed conveyor 18 supplying a continuous strip of foil; a cutting device 19 for cutting sheets 5 of foil off the continuous strip; and a feed wheel 20 for feeding sheets 5 of foil to packing wheel 16.

Station 9*f* for folding blanks 6 and collars 7 about groups 3 of cigarettes 4 and on top of the previously folded sheets 5 of foil comprises a packing wheel 21 connected to a spray-gumming unit 22 and having a number of folding heads 23. Each folding head 23 receives a blank 6 from supply station 9*d*, receives a group 3 of cigarettes 4, wrapped in a sheet 5 of foil, from packing wheel 16, receives a collar 7 from supply station 9*e*, and folds blank 6, together with collar 7, about group 3 of cigarettes 4, wrapped in sheet 5 of foil, with the aid of external folding members. Before blank 6 is folded about group 3 of cigarettes 4, wrapped in sheet 5 of foil, gumming unit 22 deposits a number of spots or areas of thermoplastic glue (or hot-melt glue) onto blank 6 on each folding head 23.

Station 9*d* for supplying blanks 6 comprises a horizontal hopper 24 containing a stack of blanks 6; and a feed wheel 25, which withdraws each blank 6 from hopper 24 and feeds blank 6 to a folding head 23 on packing wheel 21.

Supply station 9*e* is shown highly schematically, and is substantially similar to supply station 9*b*.

Station 9*g* for drying packets 2 of cigarettes comprises a transfer and reject wheel 26; a drying conveyor 27; an output conveyor 28; and optical control devices 29 defining a control station 30. When operating normally, machine 1 as described above processes materials 4, 5, 6, 7 (namely, cigarettes 4, sheets 5 of foil, blanks 6, and collars 7) to produce packets 2 of cigarettes of specific aesthetic/functional characteristics.

Figure 2:
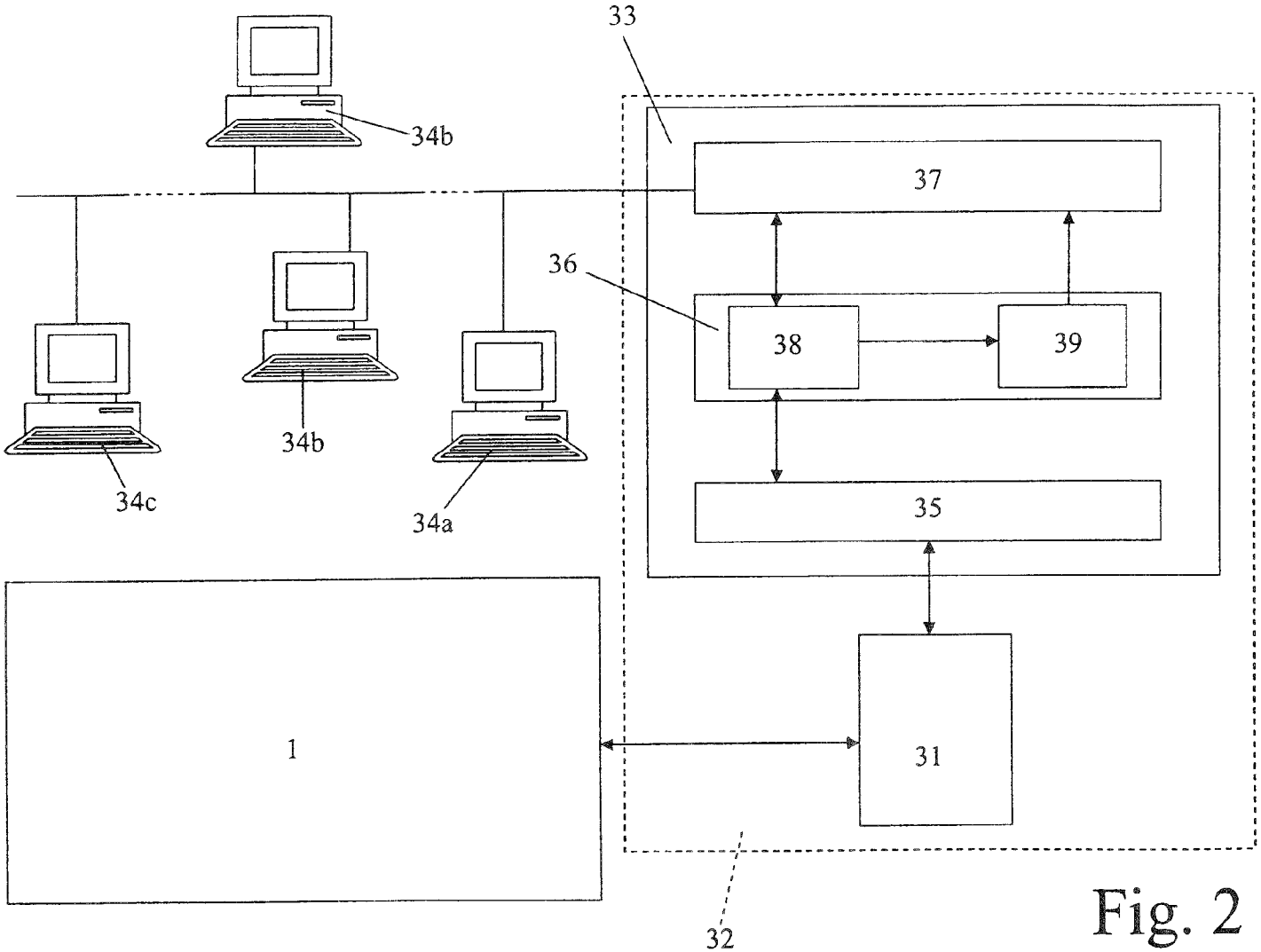
FIG. 2 shows a block diagram of a user interface device of the FIG. 1 packing machine.

As shown in FIG. 2, packing machine 1 comprises an external control unit 31 housed in one or more cabinets 32 (only one shown in FIG. 2) and connected to packing machine 1 by electric cables (not shown). Packing machine 1 also comprises a number of user interface or so-called "HMI" devices 33 (only one shown in FIG. 2), each located close to packing machine 1 or (as is frequently the case) fitted to frame 8 of packing machine 1. Each user interface device 33 comprises a known industrial computer having a data display screen (not shown in FIG. 2), and a type-in device (not shown in FIG. 2) which is normally defined by a keyboard and/or pointing device, and which may even be integrated in the screen by means of a so-called touch-screen function. Each user interface device 33 allows the operator to interact with control unit 31 of packing machine 1, e.g. to enter commands and machine configurations or to display the operating status of packing machine 1 (running, stop, waiting for materials, emergency stop, alarm).

Additional local or remote computers 34 may be connected to user interface device 33 over an Ethernet (preferably TCP/IP protocol) network, and may be used by the operator to interact with control unit 31 of packing machine 1. For example, a computer 34*a* is an industrial computer located close to the packing machine or at any rate in a production area; a computer 34*b* is an office computer located in the same building as packing machine 1; a computer 34*c* is an office computer located a considerable distance from packing machine 1. Computers 34*a* and 34*b* are connected to user interface device 33 solely over an Ethernet/Intranet network, whereas computers 34*c* are connected to user interface device 33 over the Internet network.

User interface device 33 comprises a first communication device 35 which dialogs (i.e. exchanges data both ways) with control unit 31 of packing machine 1; a memory device 36 implementing an SQL database; and a second communication device 37 which dialogs (i.e. exchanges data both ways) with the user. The two communication devices 35 and 37 only dialog indirectly with each other via memory device 36. In other words, the first communication device 35 reads/writes data in/into memory device 36 both periodically (i.e. at a constant, predetermined frequency) and at random (i.e. upon detection of an event), and, at the same time, the second communication device 37 reads/writes data in/into memory device 36 substantially at random (i.e. when the operator decides to use the user interface).

The SQL database of memory device 36 comprises a current-data table 38 storing the current values of control variables/parameters of control unit 31; and a history-data table 39 storing the values of certain control variables/parameters when particular events occur. Each value in current-data table 38 is overwritten with an updated value as soon as the updated value is available, whereas history-data table 39 is queue-managed, in the sense that a data item, as opposed to being written over an existing data item in history-data table 39, is added "to the end of the queue" in history-data table 39. To maintain a reasonable size of history-data table 39, data stored over and above a given threshold period (e.g. 1 month) is periodically deleted.

History-data table 39 stores data in the following classes:

- error messages resulting in stoppage of packing machine 1;
- other messages (reports, operator intervention requests for replacements, maintenance, adjustments, cleaning);
- production counters (number of packets 2 produced, number of packets 2 rejected, consumption of each material 4, 5, 6 or 7);
- internal analog control variables (meters) (e.g. gumming device glue level, gumming device glue temperature, compensating device fill level, lubricating oil level and temperature);
- internal digital control variables (meters) (e.g. a new reel on an unwinding unit pin);
- position/speed signals (encoders);
- format (brand) change requests;
- end-of-shift requests;
- operating parameters of packing machine 1.

More specifically, for each data item in history-data table 39 are memorized: the data item identification name; the type of event associated with the data item; any parameters associated with the event; the event start date and time; the event end date and time; the identification code of the shift in which the event occurred; and the identification code of packing machine 1.

It should be pointed out that most of the above data is generated by control unit 31 of packing machine 1 during normal operation of packing machine 1, whereas format change requests and packing machine 1 operating parameter change requests are generated by the operator using user interface device 33, and the end-of-shift request is generated by memory device 36 of user interface device 33 at the end of the work shift.

When packing machine 1 is stopped, the position/speed signals only indicate the position of the component parts of packing machine 1; and, when packing machine 1 is running, the position/speed signals only indicate the operating speed of the component parts. More specifically, any significant variations in operating speed (i.e. over a predetermined threshold value of, say, 5 rpm) are recorded to reconstruct the operating speed time pattern while minimizing memory occupancy.

For a digital internal variable, any variations in the value of the variable are recorded to reconstruct the time pattern of the variable while minimizing memory occupancy. For an analog internal variable, any significant variations in the value of the variable (i.e. over a predetermined threshold value) are recorded to reconstruct the time pattern of the variable while minimizing memory occupancy.

Figure 3:
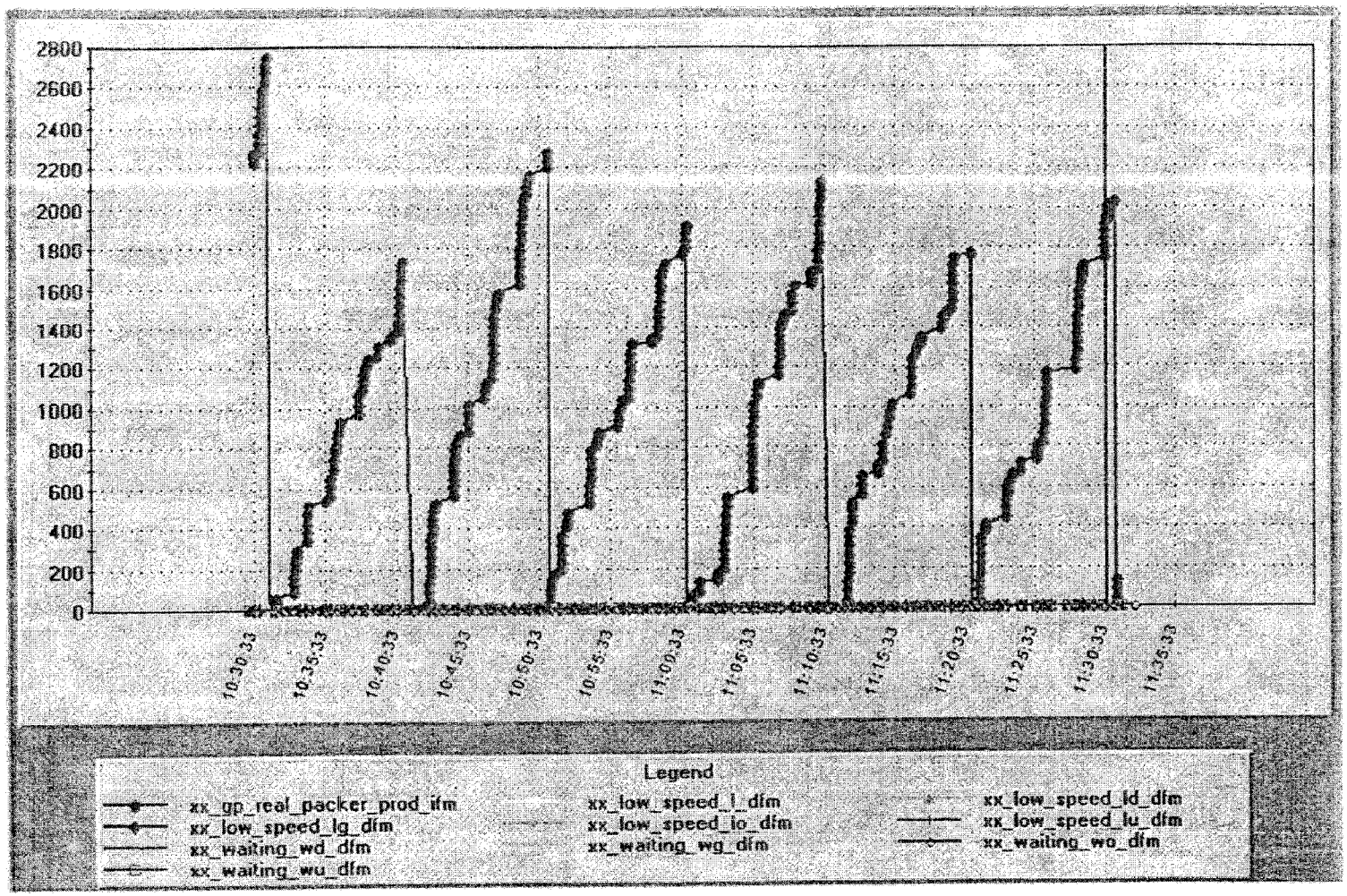
FIGS. 3 and 4 show two photographs of two graphic display modes of the FIG. 2 user interface device.
Figure 4:
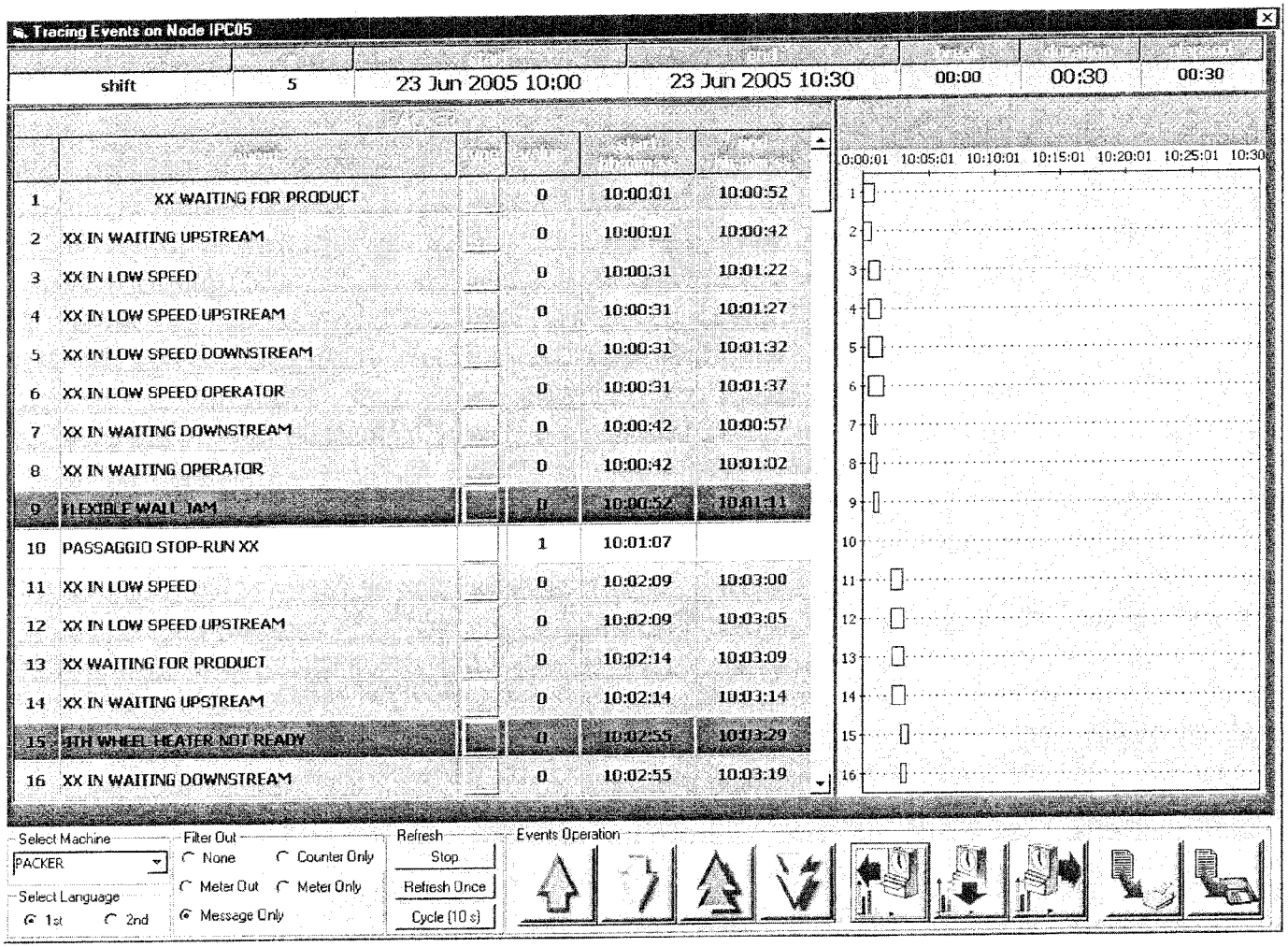

The data in history-data table 39 may be displayed in a first table mode (an example of which is shown in FIG. 4) or in a second graph mode (an example of which is shown in FIG. 3).

User interface device 33 allows the operator to select the desired display mode and, for each display mode, to select specific data for display (for example, the operator may insert selection filters to display specific individual data items, or to display sets of data in the same class or relating to the same machine).

In table display mode (FIG. 4), the data, or part of it, in history-data table 39 is listed chronologically, i.e. the data list in history-data table 39 is arranged in vertical order (upwards or downwards) as a function of the date and time of each data item; and the data list may be associated with a Gantt chart (FIG. 4) showing the start and end instants (and hence duration) of each data item. For example, table display mode may be used to determine the operations performed by the operator after a service (i.e. operator-requested) stop of packing machine 1, and to determine the status of packing machine 1 immediately prior to the service stop. From the status of packing machine 1 immediately prior to the service stop and/or the operations performed by the operator after the service stop, it is possible to determine whether the service stop was requested as a result of a problem (real or presumed) on packing machine 1, or was requested to perform jobs involving not connected with a problem on packing machine 1.

In graph display mode (FIG. 3), a cartesian graph shows the time pattern of part of the data in history-data table 39, and may (obviously using appropriate value scales) display non-homogeneous data, i.e. relating to physical quantities not directly related to one another. For example, the cartesian graph may show the time pattern of the speed of packing machine 1 synchronized with the time pattern of the number of packets 2 rejected, and with the time pattern of the glue temperature of gumming unit 22 to determine the impact (immediate or delayed) of a variation in the glue temperature of gumming unit 22 on the number of packets 2 rejected. Using the cartesian graph as described above, the optimum glue temperature of gumming unit 22, i.e. the temperature minimizing the number of packets 2 rejected, can be determined experimentally as a function of the speed of packing machine 1.

By means of pairs of values, it is also possible to determine, and therefore display, appropriate ranges within which the displayed data must remain.

It should be pointed out that both table display mode (FIG. 4) and graph display mode (FIG. 3) may show the time patterns of data in different classes simultaneously. That is, the time patterns of different types or classes of data, i.e. nonhomogeneous data, can be shown in the same display.

For example, the time patterns of a temperature, of an operating speed, and of the number of packets rejected may be displayed simultaneously.

By memorizing data in history-data table 39 and displaying the data in history-data table 39 as described above, it is therefore possible to determine the circumstances underlying both operator stoppage and automatic stoppage of packing machine 1.

Given the numerous advantages afforded, the above method of memorizing data in history-data table 39 and of displaying the data in history-data table 39 may also be applied to advantage to other types of automatic machines for processing articles in the tobacco industry, such as a cellophaning machine for producing transparent plastic overwrappings about packets 2 of cigarettes, a cartoning machine for producing cartons of packets 2 of cigarettes, or a machine for producing cigarettes 2.

For example, in the case of a cellophaning machine for producing transparent plastic overwrappings about packets 2 of cigarettes, the cartesian graph may show the time pattern of the speed of the cellophaning machine synchronized with the time pattern of the number of packets 2 rejected, and with the time pattern of the sealing temperature of a sealing device, to determine the impact (immediate or delayed) of a variation in sealing temperature on the number of packets 2 rejected. Using the cartesian graph as described above, the optimum sealing temperature, i.e. the temperature minimizing the number of packets 2 rejected, can be determined experimentally as a function of the speed of the cellophaning machine (optimum sealing temperature generally increases nonlinearly alongside an increase in the speed of the cellophaning machine).

The invention claimed is:

1. An automatic machine for processing articles in the tobacco industry; the automatic machine comprising:

at least one production line along which a number of materials are processed to produce the articles;

a number of operating members located along the production line;

a control unit configured for controlling data relating to operation of the automatic machine and belonging to the following classes: error messages resulting in automatic stoppage of the automatic machine; report messages; production counters; operator-intervention-request messages; values of analog and digital internal control variables; position/speed signals; format-change requests; end-of-shift requests; and operating parameters of the automatic machine; and a user interface device connected to the control unit and comprising a memory device configured to store information relative to the error messages resulting in automatic stoppage of the automatic machine and data belonging to at least some of said classes;

wherein the memory device stores the time patterns of data belonging to at least some of said classes by recording any variations in the digital internal control variables and recording any significant variations in the analog internal control variables to reconstruct the time pattern of the variables; and wherein the user interface device displays, in the same graphic display, the time patterns stored in the memory device of nonhomogeneous data relating to physical quantities not directly related to one another and belonging to at least some of said classes.

2. An automatic machine claimed in claim 1, wherein the production counters comprise a counter of the number of articles produced; a counter of the number of articles rejected; and a counter of consumption of each material.

3. An automatic machine claimed in claim 1, wherein all the information recorded by the memory device is generated by the control unit of the automatic machine, with the exception of format-change and end-of-shift requests, which are generated by an operator by means of an operator station connected to the user interface device.

4. An automatic machine claimed in claim 1, wherein, when the automatic machine is stopped, the position/speed signals only indicate the position of the component parts of the automatic machine; and, when the automatic machine is running, the position/speed signals only indicate the operating speed of the component parts.

5. An automatic machine as claimed in claim 1, wherein a variation in an analog internal control variable is considered significant if it is above a predetermined threshold value.

6. An automatic machine as claimed in claim 1, wherein the user interface device displays the data in a history-data table in a first table display mode, in which at least part of the data in the history-data table is listed chronologically.

7. An automatic machine as claimed in claim 6, wherein the user interface device associates with the data list a Gantt chart showing the start instant and end instant of each data item.

8. An automatic machine as claimed in claim 1, wherein the user interface device displays the data in a history-data table in a second graph mode, wherein a cartesian graph shows the time pattern of a number of data items in the history-data table.

9. An automatic machine claimed in claim 1, wherein the user interface device comprises a first communication device which dialogs with the control unit of the automatic machine;

a memory device implementing a database; and a second communication device which dialogs with an operator.

10. An automatic machine as claimed in claim 9, wherein the first and second communication device only dialog with each other indirectly via the memory device.

11. An automatic machine as claimed in claim 9, wherein, in the database are defined a history-data table in which the information to be recorded is memorized successively, and a current-data table in which the current values of control variables/parameters are memorized; each value in the current-data table is overwritten with the updated value, as soon as the updated value is available.

12. An automatic machine as claimed in claim 11, wherein the history-data table is queue-managed, wherein new information is added to the table without overwriting existing information.

* * * * *